US006514133B1

(12) United States Patent
Bernard et al.

(10) Patent No.: US 6,514,133 B1
(45) Date of Patent: Feb. 4, 2003

(54) TOOL FOR SMOOTHING OPTICAL SURFACES, IN PARTICULAR FOR OPHTHALMIC LENSES

(75) Inventors: Joël Bernard, Ormesson (FR); Jean-Marc Padiou, Champigny-sur-Marne (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 122 days.

(21) Appl. No.: 09/609,373

(22) Filed: Jul. 3, 2000

(30) Foreign Application Priority Data

Jul. 2, 1999 (FR) ..... 99 08564

(51) Int. Cl.[7] ..... B24B 33/00
(52) U.S. Cl. ..... 451/540; 451/548
(58) Field of Search ..... 451/514, 548, 451/540

(56) References Cited

U.S. PATENT DOCUMENTS 1,970,835 A * 8/1934 Benner ..... 451/548
2,065,941 A * 12/1936 Lane ..... 451/548
2,065,942 A * 12/1936 Lane ..... 451/548
2,110,619 A * 3/1938 Beth ..... 451/548
2,235,446 A * 3/1941 Birger et al. ..... 15/4
2,716,312 A * 8/1955 Speicher ..... 451/342
3,034,625 A * 5/1962 Grote ..... 192/102
4,549,372 A 10/1985 Sexton et al.
5,472,373 A * 12/1995 Wolters ..... 451/259
5,507,686 A * 4/1996 Wolters ..... 451/435

FOREIGN PATENT DOCUMENTS

JP 57-168853 * 10/1982
JP 3-221362 A * 9/1991
JP 09-085605 3/1997
JP 09-239666 9/1997

* cited by examiner

*Primary Examiner*—M. Rachuba
(74) *Attorney, Agent, or Firm*—Young & Thompson

(57) ABSTRACT

A tool for smoothing optical surfaces including a rigid support and a generally annular working member which is at least in part axially deformable. The support forms a recessed annular housing and the working member is attached to the support via the bottom of the annular housing but projects beyond the support. Applications include smoothing ophthalmic lenses, whether made from a mineral material or an organic material.

14 Claims, 1 Drawing Sheet

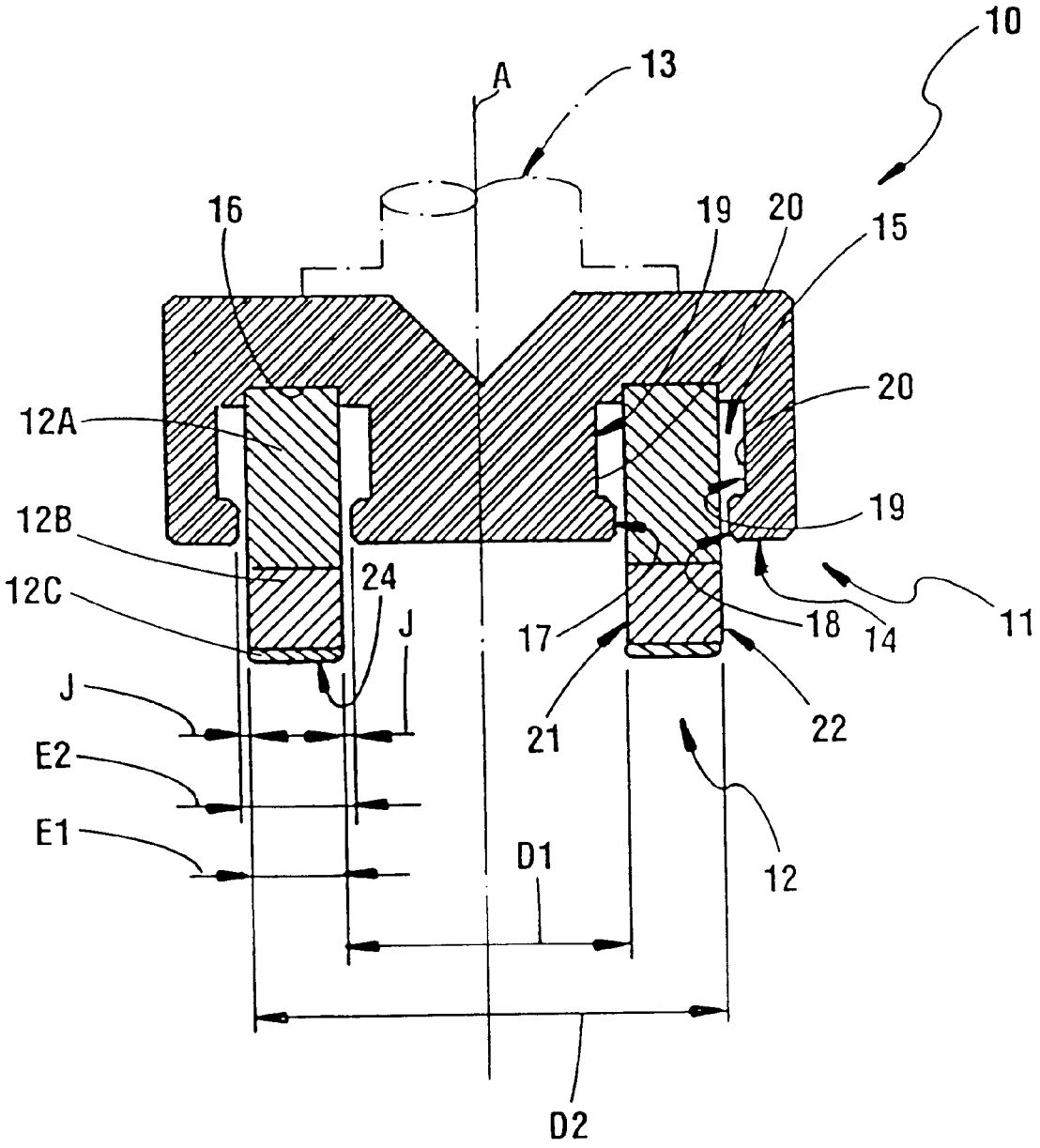
10
A
13
16
19
20
15
20
12A
19
12B
24
12C
J
17
18
14
11
J
21
22
E2
E1
D1
12
D2

TOOL FOR SMOOTHING OPTICAL SURFACES, IN PARTICULAR FOR OPHTHALMIC LENSES

BACKGROUND OF THE INVENTION

1. Field of the Invention

The present invention relates generally to tools of the type employed to smooth an optical surface.

2. Description of the Prior Art

Here, in the usual way, the term "smoothing" means both polishing and buffing a surface.

The tools employed for such smoothing generally include a rigid support and a working member fastened to the support. This is the case in particular with tools for smoothing ophthalmic lenses.

The present invention more particularly addresses the situation in which this member is of generally annular form and is at least in part elastically deformable.

A smoothing tool including a working member of this kind is described in German utility model No. 298 03 158, for example.

Because of its annular shape, the dimensions and stiffness of the working member can be sufficient for it to procure the required smoothing effect, its central opening minimizing its overall volume and therefore the quantity of elastically deformable material that actually has to be deformed.

This compromise is all the more advantageous in that, in practice, the active portion of a working member of this kind, i.e. the portion of the working member which does the most work, is its peripheral potion when, as here, the working member is rotated about its axis in use.

The elastically deformable portion of the working member advantageously enables it to adapt as closely as possible to the surface to be smoothed, with optimum equilibrium of the corresponding contact pressure.

A general object of the present invention is an arrangement offering improved control of the working member.

SUMMARY OF THE INVENTION

To be more precise, the present invention provides a tool for smoothing optical surfaces including a rigid support and a generally annular working member which is at least in part axially deformable, wherein the support forms a recessed annular housing and the working member is attached to the support via the bottom of the annular housing but projects beyond the support.

In other words, by virtue of the annular housing that it includes to receive it, the support surrounds the root portion of the working member and is therefore able to hold and guide the working member, which is to the benefit of its working conditions.

Furthermore, by channeling the swelling of the elastically deformable part of the working member which is inevitable in use, the support facilitates obtaining a uniform distribution of the contact pressure between the working member and the worked optical surface.

To accommodate this swelling as much as possible, at least one relief groove is preferably provided on at least one lateral surface of the annular housing of the support according to the invention.

Thus an advantageous compromise is also achieved between, on the one hand, the required holding and guiding of the working member and, on the other hand, the volume available to receive the part, despite any deformation thereof.

The features and advantages of the invention will emerge from the following description, which is given by way of example and with reference to the accompanying drawing, in which the single figure is a view in axial section of a smoothing tool according to the invention.

DETAILED DESCRIPTION OF THE PREFERRED EMBODIMENT

As shown in the FIGURE, and in a manner that is known in the art, the smoothing tool 10 according to the invention includes a rigid support 11 and a working member 12 which is fastened to the support 11.

In a manner which is also known in the art, and symbolized in chain-dotted line in the FIGURE, the support 11 is carried by a shaft 13 adapted to drive it in rotation.

A is the corresponding rotation axis.

In practice the support 11 forms a circular body of revolution about the rotation axis A.

Finally, in a manner also known in the art, the working member 12 is of generally annular form, its axis is coincident with the rotation axis A, and it is at least in part elastically deformable, as described in more detail below.

According to the invention the support 11 has a recessed annular housing 15 in its transverse surface 14 opposite the shaft 13, i.e. its free surface, and the working member 12 is attached to the support 11 via the bottom 16 of the annular housing 15, although it obviously projects beyond the support 11, i.e. beyond its transverse surface 14.

In practice, like the working member 12, the annular housing 15 of the support 11 has an axis coincident with the rotation axis A.

In practice, the transverse surface 14 of the support 11 is substantially perpendicular to the rotation axis A.

In addition to the bottom 16, the annular housing 15 in the support 11 is delimited by coaxial inside and outside lateral surfaces 17, 18, both of which have their axis coincident with the rotation axis A and both of which are globally cylindrical and substantially perpendicular to the bottom 16.

As is the case in the embodiment shown, the support 11 preferably includes at least one relief groove 19 on at least one of the lateral surfaces 17, 18 of its annular housing 15.

For example, and as shown here, there is a single relief groove 19 on each lateral surface 17, 18 of the annular housing 15 of the support 11.

The relief groove 19 is in the middle area of the lateral surfaces 17, 18, occupies more than half their height and, in the embodiment shown, its bottom 20 is cylindrical and its axis is coincident with the rotation axis A.

In the embodiment shown, the working member 12 is delimited by inside and outside cylindrical lateral surfaces 21, 22 and covers the whole of the bottom 16 of the annular housing 15 of the support 11.

D1 is the inside diameter of the working member 12, D2 is its outside diameter and E1 its thickness.

E2 is the width of the annular housing 15 of the support 11 where it opens to the outside.

As is the case in the embodiment shown, the width E2 is preferably greater than the thickness E1 of the working member 12 so that there is a clearance J on each side of the working member 12 at the exit from the annular opening 15 of the support 11.

In the embodiment shown by way of example, which is more particularly concerned with the situation in which the optical surface to be worked is a portion of a mineral material part, not shown, the working member 12 has three portions.

Starting from the bottom 16 of the annular housing 15 of the support 11, it first includes an elastically deformable core 12A.

The elastically deformable core 12A is made of elastomer, for example.

Its elasticity is chosen according to its required deformation capacity and the bearing force it has to withstand in use.

For example, the Shore A hardness of the elastically deformable core 12A is from 30 degrees to 80 degrees and preferably from 50 degrees to 60 degrees.

As shown here, the elastically deformable core 12A preferably extends beyond the support 11.

In other words, it projects from the transverse surface 14 thereof.

In the embodiment shown, the working member 12 next includes a surface layer 12B between its elastically deformable core 12A and its working surface 24, which is formed by its free surface opposite the bottom 16 of the annular housing 15. The surface layer 12B is elastically deformable but less elastic than the elastically deformable core 12A.

The function of the elastically deformable core 12A is to absorb deformation of the worked optical surface, enabling the assembly to adapt to that optical surface. The function of the surface layer 12B is to make the assembly rigid enough for the required smoothing to be obtained.

The surface layer 12B is made of polyurethane, for example.

It can instead be made of elastomer, however, provided that the elastomer is less deformable than that of the elastically deformable core 12A.

The Shore A hardness of the surface layer 12B is preferably at least 50 degrees.

It is from 80 degrees to 90 degrees, for example.

The dimension of the surface layer 12B parallel to the rotation axis A is preferably matched to the required flexibility.

If necessary, the surface layer 12B can be a multilayer arrangement to generate an elasticity gradient.

In the embodiment shown the working member 12A finally includes at its free end an abrasive film 12C which forms its working surface 24.

The abrasive film 12C is made of polyester, for example, and carries abrasive grains whose particle size ranges from 0.25 $\mu$m to 45 $\mu$m.

However, as an alternative to this, instead of being incorporated into an abrasive film 12C of this kind, the abrasive grains can be conveyed in a fluid, such as a liquid, a gel or an aerosol, for example, and entrained by a support cloth of woven fabric or foam, for example, or by a grid, for example by virtue of being flocked onto the support cloth or grid.

The three portions of the working member 12, namely the elastically deformable core 12A, the surface layer 12B and the abrasive film 12C, are glued together, for example, and likewise the working member 12 is in turn glued to the support 11.

The dimensions of the working member 12 are preferably made sufficiently large relative to those of the defects to be smoothed to have no effect on the required components of shape for the worked optical surface and sufficiently small for the tool to adapt locally to the shape of the part, so that the discrepancy between the deformations of the working surface 24 and the surface to be treated are as small as possible.

Particularly satisfactory results have been obtained with the following values of the dimensions, which are given here by way of example and without any limiting effect on the present invention:

D1 from 6 mm to 16 mm, preferably from 6 mm to 10 mm,

D2 from 10 mm to 20 mm, preferably from 10 mm to 15 mm,

E1 from 2 mm to 4 mm, preferably from 2 mm to 3 mm.

In practice, the elasticity of the surface layer 12B can vary from that of the elastically deformable core 12A up to that of a metal.

In other words, in an embodiment that is not known, the surface layer 12B is formed by a thin and flexible metal film.

In another embodiment, also not shown, which is more particularly suited to the situation in which the worked optical surface is a portion of an organic material part, the surface layer 12B is purely and simply eliminated.

More generally, the present invention is not limited to the embodiment more particularly described and shown, but encompasses any variant execution thereof.

There is claimed:

1. A tool for smoothing optical surfaces including a rigid support adapted to be driven in rotation about a rotational axis and a generally annular working member which is at least in part axially elastically deformable, wherein said support forms a recessed annular housing with a bottom, said annular housing being delimited by coaxial inside and outside lateral surfaces which are substantially perpendicular to said bottom and have axes coincident with said rotational axis, and said working member is attached to said support via the bottom of said annular housing but projects beyond said support, and at least one said lateral surface of said annular housing comprises at least one relief groove to accommodate a swelling of the elastically deformable part of the working member.

2. The smoothing tool claimed in claim 1 wherein said working member has an elastically deformable core adjoining said bottom of said annular housing of said support.

3. The smoothing tool claimed in claim 2 wherein said elastically deformable core of said working member extends beyond said support.

4. The smoothing tool claimed in claim 2 wherein the Shore A hardness of said elastically deformable core of said working member is from 30 degrees to 80 degrees.

5. The smoothing tool claimed in claim 2 wherein said working member has a surface layer between its elastically deformable core and its working surface which is itself elastically deformable but less elastic than said elastically deformable core.

6. The smoothing tool claimed in claim 5 wherein the Shore A hardness of said surface layer of said working member is at least 50 degrees.

7. The smoothing tool claimed in claim 6 wherein the Shore A hardness of said surface layer of said working member is from 80 degrees to 90 degrees.

8. The smoothing tool claimed in claim 6 wherein the surface layer of said working member is metal.

9. The smoothing tool claimed in claim 1 wherein said working member has an abrasive film at its free end which forms its working surface.

10. The smoothing tool claimed in claim 1 wherein the inside diameter of said working member is from 6 mm 16 mm.

11. The smoothing tool claimed in claim 1 wherein the outside diameter of said working member is from 10 mm 20 mm.

12. The smoothing tool claimed in claim 1 wherein the thickness of said working member is from 2 mm to 4 mm.

13. The smoothing tool claimed in claim 1 including a relief groove on each lateral surface of said annular housing of said support.

14. The smoothing tool of claim 8, wherein the surface layer is a thin, flexible metal film.

* * * * *